US007266292B1

(12) United States Patent
Tsai

(10) Patent No.: US 7,266,292 B1
(45) Date of Patent: Sep. 4, 2007

(54) STRUCTURE OF STEAM SWAB

(75) Inventor: Sam Tsai, 4F, No. 14, Lane 287, Sec. 2, Siyuan Road, Wanhua District (TW)

(73) Assignee: Sam Tsai, Wanhua District (TW)

( * ) Notice: Subject to any disclaimer, the term of this patent is extended or adjusted under 35 U.S.C. 154(b) by 0 days.

(21) Appl. No.: 10/983,124

(22) Filed: Nov. 8, 2004

(51) Int. Cl.
*A47J 31/00* (2006.01)

(52) U.S. Cl. ..... 392/465; 15/320; 392/405

(58) Field of Classification Search ..... None
See application file for complete search history.

(56) References Cited

U.S. PATENT DOCUMENTS 5,232,298 A * 8/1993 Mitsunari et al. ..... 401/140
6,571,421 B1 * 6/2003 Sham et al. ..... 15/320
6,584,990 B2 * 7/2003 Shaw ..... 134/105
2003/0115711 A1 * 6/2003 Rosa et al. ..... 15/320
2004/0031506 A1 * 2/2004 Tsai ..... 134/105

* cited by examiner

*Primary Examiner*—Thor S. Campbell
(74) *Attorney, Agent, or Firm*—Venable LLP

(57) ABSTRACT

A structure of steam swab comprises a rod assemblage and a base assemblage. The rod assemblage comprises a handle, a first sleeve, a second sleeve, a third sleeve, and a water tank. With a fastener set at the end, the handle and the two ends of each of the first, the second, and the third sleeves can be easily assembled to the rod assemblage. The second sleeve comprises a tank fastener base and a tank fastener ring to fasten the water tank. The base assemblage comprises a triangular lid, a steam chamber body, and a base. The triangular lid comprises a pivot connector, which can pivotally connect to the rod assemblage. An appropriate concave is set in each angle of the triangular lid to fix with a spring and a clamp. The steam chamber body and a power control unit are set in the base, and the triangular lid covers on the base to assemble the base assemblage. The base assemblage connects to the rod assemblage via the pivot connector to assemble the steam swab.

11 Claims, 4 Drawing Sheets

STRUCTURE OF STEAM SWAB

BACKGROUND OF THE INVENTION

1. Field of the Invention

The present invention relates to a structure of steam swab, especially to a fast assembly of the swab with a water tank and a triangular lid comprising a steam chamber body. When utilizing, the liquid contained in the water tank flows into the steam chamber body and is boiled to steam. Through the steam hole the cotton covering on the bottom of the base assemblage absorbs the steam to clean via high temperature steam.

2. Description of the Related Art

Swabs are the common tools used to clean the surface. For easier usage, many different designs were created to increase cleaning efficiency. For example, the U.S. patent application Ser. No. 10/217,443 "Retaining Device for a Steam Swab" disclosed a structure of steam swab which boils liquid to the cotton to clean. But this prior art is complex and costs high; especially the tank and the steam chamber are set low in the base structure with low liquid pressure. Following, the liquid in the steam chamber is few and soon the swab becomes burned. That will cause a seriously risk to users. Second, the tank is small to fit in the base so it is inconvenient to add water frequently. Otherwise the larger tank increases the size of the base and also the weight.

SUMMARY OF THE INVENTION

Accordingly, the primary object of the present invention is to provide a steam swab with a simple structure and easy to assemble to use. The second object, via interchangeable segments of sleeves, the rod of the steam swab can be assembled ready for use fast and conveniently. The third object is to set the water tank attached on the rod, with appropriate capacity and larger tank exchangeable. The higher water tank produces natural liquid pressure making water flow into the steam chamber. The fourth object is to reduce dead space with the triangular base. And the fifth object is a pivotable connector to pivot the rod into the base. The base can rotate to an appropriate angle to clean larger area with fewer moves.

To achieve the above-mentioned objects, the present invention provides a structure of steam swab. The steam swab comprises a rod assemblage and a base assemblage. The rod assemblage comprises a handle, a first sleeve, a second sleeve, a third sleeve, and a water tank. With a rod fastener and a rod fattener base set corresponding at the ends, the handle and the two ends of each of the first, the second, and the third sleeves can be easily assembled each other to the united rod assemblage.

Said handle comprises an appropriate nonslip design, and at the bottom end comprises a rod fastener. The first sleeve comprises a plurality of wire clips, a rod fastener base at the top end, and a rod fastener at the bottom end. The second sleeve comprises a rod fastener base at the top end to fasten with the rod fastener of the first sleeve, a rod fastener at the bottom end to fasten with the third sleeve, and a tank fastener ring and a tank fastener base on the surface to fit a water tank, wherein the tank fastener base comprises a channel connected with the cannular second sleeve and liquid in the water tank can flow through into the sleeves. The third sleeve comprises a rod fastener base at the top end, and a rod fattener to fasten with a pivot connector of the base assemblage. The water tank, which comprises a fillister to fit the second sleeve, a tank handle, and a bung, contains water or other appropriate liquid sanitary agent. At the end of the water tank also comprises a valve wherein connects to the tank fastener base and controls the liquid from the water tank flowing through the sleeves into the base assemblage.

The base assemblage comprises a triangular lid, a steam chamber body, and a base. The triangular lid comprises a pivot connector, which can pivotally connect to the rod assemblage. An appropriate concave is set at each angle of the triangular lid, which comprises a first concave, a second concave, and a third concave to fix with each a spring, a first clamp, a second clamp, and a third clamp. The triangular lid also comprises a power cord, a button, a power indicator light, and a temperature indicator light. The steam chamber body is hollow and made by thermal conductive metal material wherein comprises a waterway, a plurality of steam spouts, and a plurality of heater tubes. The liquid in the water tank flows into the steam chamber body and heats boiled to steam, which is released via the steam spouts. The shape of the base corresponds to the triangular lid. The steam chamber body and a power control unit are set in the base, which comprises a plurality of blowholes at the bottom corresponding to the steam spouts of the steam chamber body, and the triangular lid covers on the base to assemble the base assemblage. The base assemblage connects to the rod assemblage via the pivot connector to assemble the steam swab.

The various objects and advantages of the present invention will be more readily understood from the following detailed description when read in conjunction with the appended drawings.

DETAILED DESCRIPTION OF THE INVENTION

In the following, a better embodiment of this invention is described with figures for further details.

Figure 1:
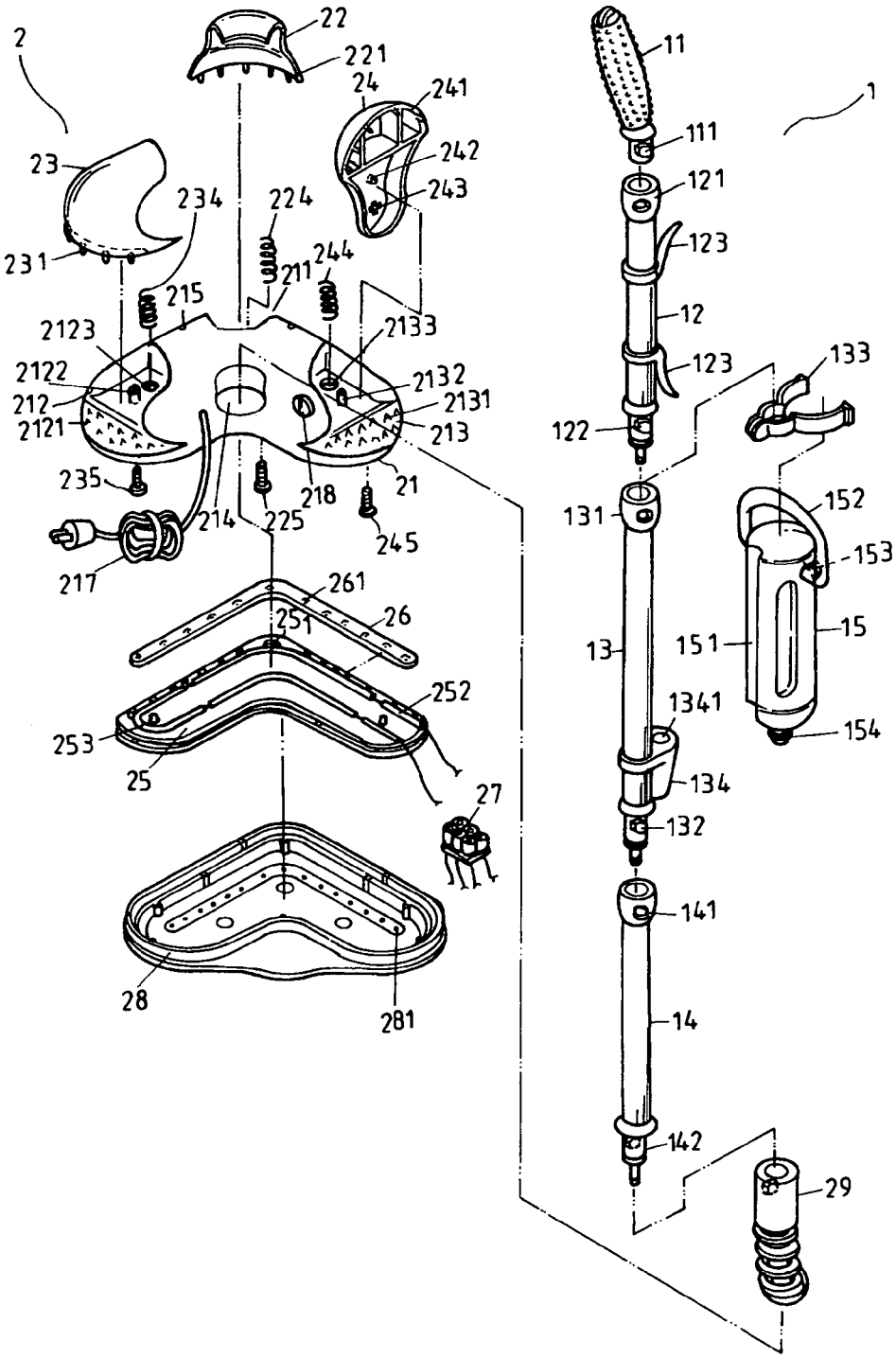
FIG. 1 illustrates an exploded view of the present invention.

FIG. 1 is an exploded view of an embodiment. The steam swab comprises a rod assemblage 1 and a base assemblage 2. The rod assemblage 1 comprises a handle 11, a first sleeve 12, a second sleeve 13, a third sleeve 14, and a water tank 15. Said handle 11 comprises an appropriate nonslip design, and at the bottom end comprises a rod fastener 111. The first sleeve comprises two wire clips 123, a rod fastener base 121 at the top end to fasten with the rod fastener 111 of the handle 11, and a rod fastener 122 at the bottom end.

The second sleeve 13 is cannular and comprises a rod fastener base 131 at the top end to fasten with the rod fastener 122 of the first sleeve 12, a rod fastener 132 at the bottom end to fasten with the third sleeve 14, and a tank fastener ring 133 and a tank fastener base 134 on the surface, wherein the tank fastener base 134 comprises a grommet 1341 and a channel connected with the cannular second sleeve 13 inside, and liquid in the water tank 15 can flow through into the sleeves.

The water tank 15 comprises a fillister 151 at the back to fit the second sleeve 13, a tank handle 152 at the top, and a bung 153. At the end of the water tank 15 also comprises a valve 154 wherein connects to the grommet 1341 of the tank fastener base 134 and controls the liquid from the water tank 15 flowing through the second sleeve 13 and third sleeve 14 into the base assemblage 2.

The third sleeve 14 is also cannular and comprises a rod fastener base 141 at the top end, and a rod fattener 142 at the bottom end.

The rod fasteners of the handle 11, the first sleeve 12, the second sleeve 13, and the third sleeve 14 all comprise a pushing button positioner with a spring raised from the surfaces of the rod fasteners. The rod fastener bases of the first sleeve 12, the second sleeve 13, and the third sleeve 14 can fasten with the corresponding rod fasteners of the handle 11, the first sleeve 12, the second sleeve 13, and the third sleeve 14. The each rod fastener base also comprises a positioner hole to fit the pushing button positioner. Via the rod fasteners and the rod fastener bases, the sleeves can be fast connected to a united rod assemblage 1.

The base assemblage 2 comprises a triangular lid 21, a steam chamber body 25, and a base 28. The triangular lid 21 comprises a pivot hole 214, which connected with a pivotable pivot connector 29. An appropriate concave is set at each angle of the triangular lid 21, which comprises a first concave 211, a second concave 212, and a third concave 213 to fix with each corresponding a spring 224, 234, and 244, a first clamp 22, a second clamp 23, and a third clamp 24. The triangular lid 21 also comprises a power cord 217, a power button 218, a power indicator light 215, and a temperature indicator light 216. The pivot connector 29 comprises a fastener base at the top, and at the bottom connects with the pivot hole 214 of the triangular lid 21. The fastener base of the pivot connector 29, which can fastener the rod fasteners 122, 134, and 142 of the sleeves 12, 13, and 14, is the same with the rod fastener bases 121, 131, and 141. The concaves 211, 212, and 213 comprise a plurality of antiskid verrucae 2121, and 2131 (the verrucae of the first concave 211 are not shown in this figure due to the viewing angle) on the down edge of the outside surface. Inside the concaves 211, 212, and 213 each comprises a spring block 2123, and 2133, and a screw hole 2122, and 2123 (the spring block and the screw hole of the first concave 211 also are not shown in this figure due to the viewing angle).

The first clamp 22, the second clamp 23, and the third clamp 24 each comprises a cross spring block 243 and a screw nut 242 (only the parts of the third clamp 24 are exemplified shown in this figure, the parts of the first clamp 22 and the second clamp 23 that are not shown are all the same with above mention) which are each corresponding to the spring block and screw hole of the specific concave. The clamps 22, 23, and 24 also comprise a plurality of antiskid verrucae 221, 231, and 241 at the edges of the bottom surfaces. Set the springs 224, 234, and 244 each into the corresponding spring blocks (including the spring block 2123 and the spring block 2133) of the concaves 211, 212, and 213. A screw 245 is screwed into the screw hole 2132 of the third concave 213 and the screw nut 242 of the third clamp 24 to combine with the triangular lid 21 (all other the screws 225, 235, the concaves 211, 212, and the clamps 22, 23 are the same). The clamps 22, 23, and 24 can raise (as shown in this figure), and are limited by the springs.

The steam chamber body 25 is hollow and made by thermal conductive metal material wherein comprises a waterway 251, a plurality of steam spouts 252, and a heater tube 253. The liquid in the water tank 15 flows into the steam chamber body 25 via the waterway 251 and heats boiled to steam, which is released through the steam spouts, via the steam chamber body 25 heated by the heater tube 253.

A heatproof sheath 26 is set on the steam chamber body 25 and comprises a plurality of steam pores 261 corresponding to the steam spouts 252. With the heatproof sheath 26 protections, the base assemblage 2 can avoid heat damaged by steam chamber body 25.

The shape of the base 28 corresponds to the triangular lid 21. The steam chamber body 25 and a power control unit 27 are set in the base 28, which comprises a plurality of blowholes 281 at the bottom corresponding to the steam pores 261 of the heatproof sheath 26, and the triangular lid 21 covers on the base 28 to assemble the base assemblage 2.

Figure 2:
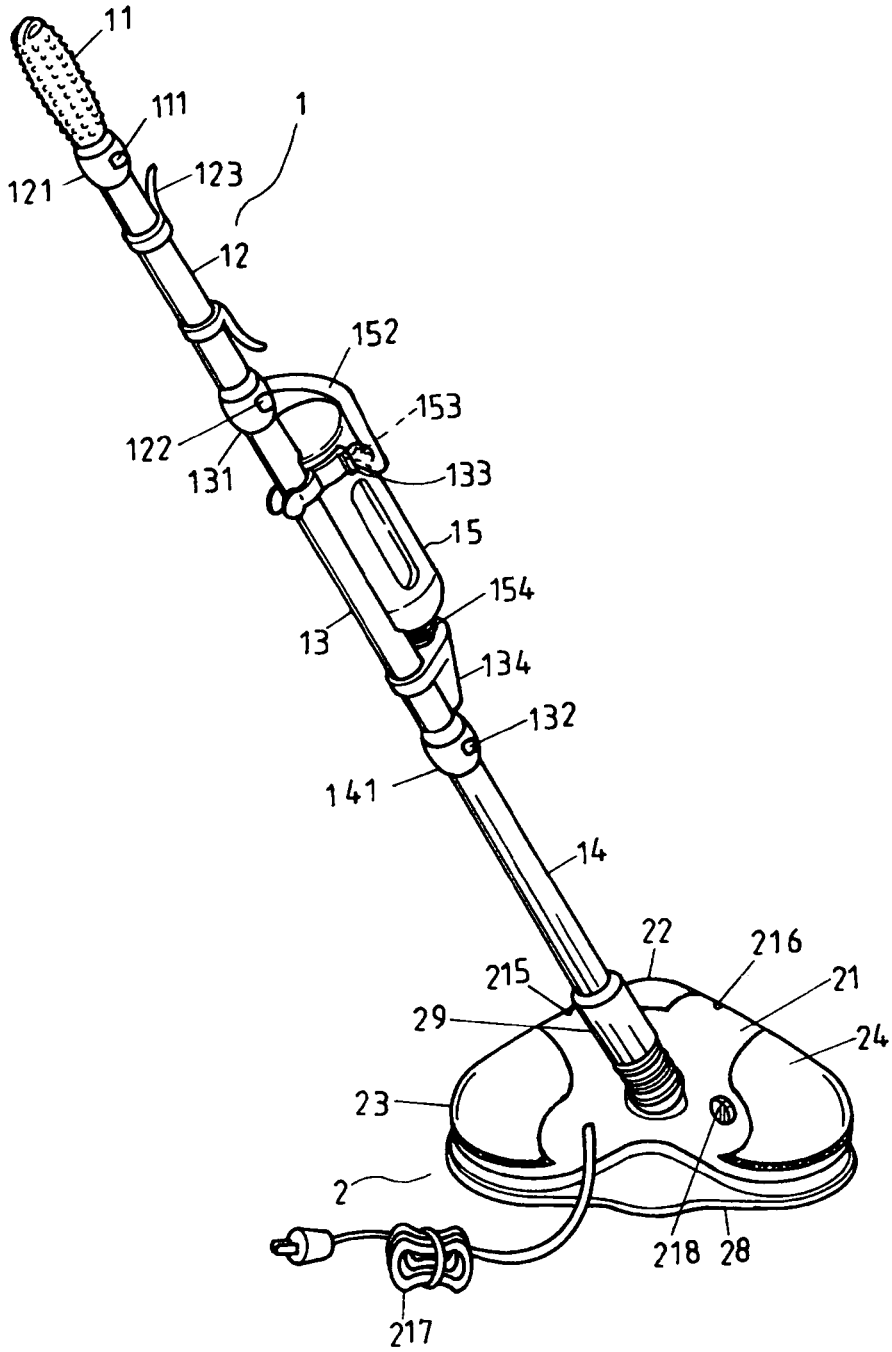
FIG. 2 illustrates a perspective view of the present invention.

The base assemblage 2 connects to the rod assemblage 1 via the pivot connector 29 to assemble the steam swab as shown in the FIG. 2.

Figure 3A:
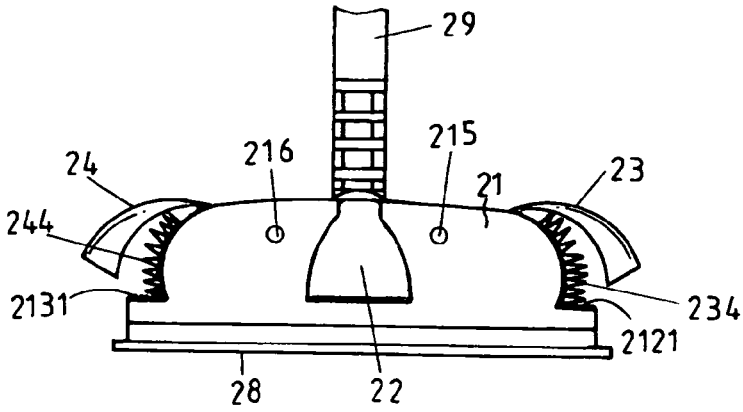
FIG. 3A illustrates a front view of the unlocked clamps of the present invention.
Figure 3B:
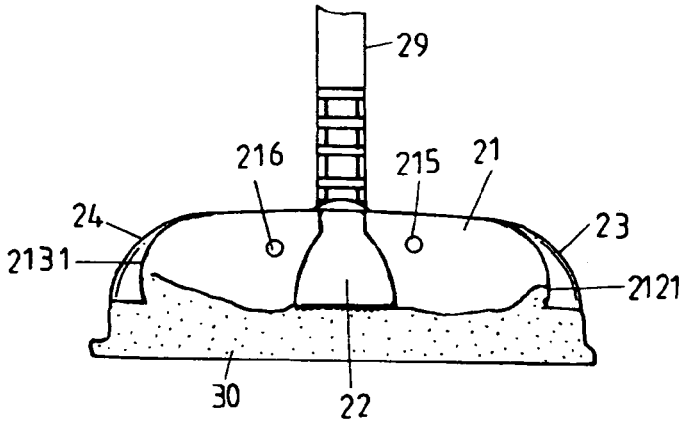
FIG. 3B illustrates a front view of the clamps engagement of the present invention.

Please refer to FIG. 3A and FIG. 3B, which are demonstrations of actions of the clamps 22, 23, and 24. The clamps 22, 23, and 24 are installed into the triangular lid 21 by screws and limited by the sprigs. The outside of the clamps 22, 23, and 24 can raise, and a cleaning cotton 30 can set below, as shown in FIG. 3B. The cleaning cotton 30 is replaceable and replacement is convenient.

Figure 4:
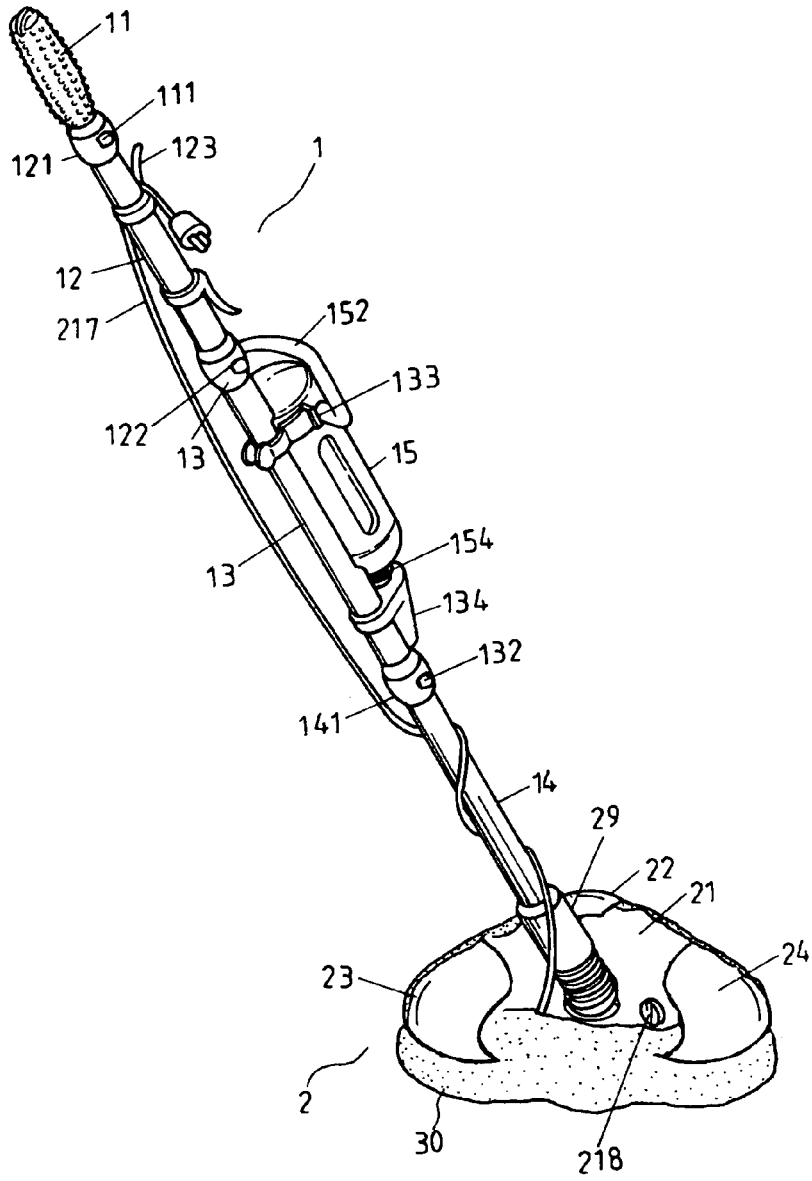
FIG. 4 illustrates another perspective view of the present invention.

FIG. 4 illustrates a perspective view 2 of the present invention. In this figure shows a embodiment of the steam swab with the cleaning cotton 30. Loading water or other appropriate liquid sanitary agent via the bung 153 into the water tank 15 and plugging the power cord 217 into the outlet, the steam swab can be used to clean immediately. By the valve 154 controlling the flow rate, liquid from the water tank 15 flows through the tank fastener base 134, the the second sleeve 13, and third sleeve 14 into the steam chamber body 25 of the base assemblage 2 via the waterway 251. The power control unit 27 controls the heat tube 253 heating the steam chamber body 25 to boil liquid to steam. Steam is released outside the steam chamber body 25 through the steam spouts 252, and the clean cotton 30 absorbs steam via the blowholes 281 of the base 28 to clean. Steam can in crease cleaning ability of swab. The power indicator light 215 lights when the power turned on. For users' safety, the temperature indicator light 216 lights when the steam chamber body 25 is overheated.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications intend to be embraced within the scope of the invention as defined in the appended claims.

What is claimed is:

1. A structure of steam swab, which comprises a cannular rod assemblage and a base assemblage, wherein the rod assemblage comprises a tank fastener ring and a tank fastener base on its surface to fit a water tank, the tank fastener base comprises a grommet and a channel that connected with the cannular rod assemblage inside, and liquid in the water tank can flow through into the cannular rod assemblage and down into the base assemblage, the base assemblage is triangular and comprises a pivotable pivot connector which can connect to the rod assemblage, inside the base assemblage comprises at least a steam chamber body to heat liquid transported via the rod assemblage to steam and to release steam through a base at the bottom of the base assemblage.

2. The structure of steam swab of claim 1, wherein said rod assemblage comprises a handle, a cannular first sleeve, a cannular second sleeve, and a cannular third sleeve.

3. The structure of steam swab of claim 2, wherein said handle, said first sleeve, said second sleeve, and said third sleeve each comprises a rod fastener and a rod fattener base set corresponding at the top end and the bottom end.

4. The structure of steam swab of claim 2 or 3, wherein said second sleeve comprises a tank fastener ring and a tank fastener base on its surface.

5. The structure of steam swab of claim 1, wherein said water tank comprises a fillister to fit the rod assemblage, a tank handle and a bung at the top, at the end of the water tank further comprises a valve to connect to the tank fastener base.

6. The structure of steam swab of claim 1, wherein said base assemblage further comprises a triangular lid, a steam chamber body, a heatproof sheath, and a base.

7. The structure of steam swab of claim 6, wherein said triangular lid comprises a pivotable pivot connector at its top, and an appropriate concave is set at each angle of the triangular lid, which comprises a first concave, a second concave, and a third concave to fix with each corresponding a first clamp, a second clamp, and a third clamp, the triangular lid further comprises a power cord, a power button, a power indicator light, and a temperature indicator light on its surface.

8. The structure of steam swab of claim 6, wherein said steam chamber body, which is hollow and made by thermal conductive metal material, comprises a waterway, a plurality of steam spouts, and at least a heater tube.

9. The structure of steam swab of claim 6, wherein said heatproof sheath, which is made by a heatproof plastic material, comprises a plurality of steam pores corresponding to the steam spouts of the steam chamber body.

10. The structure of steam swab of claim 6, wherein said base, which is shaped into a concave kind base correspond-ing to the triangular lid to fit in a unit, can contain the steam chamber body, and comprises a power control unit and a plurality of blowholes at the bottom corresponding to the steam pores of the heatproof sheath.

11. A structure of steam swab, which comprises a rod assemblage and a base assemblage, wherein:

said rod assemblage comprises:

a handle which comprises an appropriate nonslip design, and a rod fastener at the bottom end;

a first sleeve which comprises a plurality of wire clips, a rod fastener base at the top end and a rod fastener at the bottom end;

a second sleeve which is cannular and comprises a rod fastener base at the top end, a rod fastener at the bottom end, and a tank fastener ring and a tank fastener base on its surface;

a third sleeve which is cannular and comprises a rod fastener base at the top end, and a rod fastener at the bottom end;

a water tank which comprises a fillister at its back, a tank handle and a bung at the top, and a valve at the end, wherein the valve connects to tank fastener base and controls the liquid from the water tank flowing through the second sleeve and third sleeve into the base assemblage;

said base assemblage comprises: a triangular lid which comprises pivotable pivot connector, and an appropriate concave set at each angle of the triangular lid, comprising a first concave, a second concave, and a third concave, to fix with each corresponding a spring, a first clamp, a second clamp, and a third clamp, the triangular lid further comprises a power cord, a power button, a power indicator light, and a temperature indicator light on its surface;

a steam chamber body which is hollow and made by thermal conductive metal material, comprising a waterway, a plurality of steam spouts, and at least a heater tube, to heat liquid from the water tank to steam and to release steam through a base at the bottom of the base assemblage;

a heatproof sheath which is made by a heatproof plastic material, comprising a plurality of steam pores set on and corresponding to the steam spouts of the steam chamber body;

a base which is shaped into a concave kind base corresponding to the triangular lid to fit in a unit, comprising a power control unit and a plurality of blowholes at the bottom corresponding to the steam pores of the heatproof sheath.

* * * * *